US008538303B2

(12) United States Patent
Matsuda et al.

(10) Patent No.: US 8,538,303 B2
(45) Date of Patent: Sep. 17, 2013

(54) DEVELOPER CARRYING MEMBER, METHOD FOR ITS PRODUCTION, AND DEVELOPING ASSEMBLY

(71) Applicant: Canon Kabushiki Kaisha, Tokyo (JP)

(72) Inventors: Takuma Matsuda, Susono (JP); Masayoshi Shimamura, Yokohama (JP); Yasutaka Akahashi, Yokohama (JP); Satoshi Otake, Numazu (JP); Minoru Ito, Susono (JP); Kazuhito Wakabayashi, Mishima (JP); Atsushi Noguchi, Numazu (JP); Hironori Mori, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/666,799

(22) Filed: Nov. 1, 2012

(65) Prior Publication Data

US 2013/0051859 A1 Feb. 28, 2013

Related U.S. Application Data

(63) Continuation of application No. PCT/JP2012/004916, filed on Aug. 2, 2012.

(30) Foreign Application Priority Data

Aug. 3, 2011 (JP) ..... 2011-170042

(51) Int. Cl.
*G03G 15/09* (2006.01)

(52) U.S. Cl.
USPC ..... 399/276; 399/286

(58) Field of Classification Search
USPC ..... 399/276, 279, 286
See application file for complete search history.

(56) References Cited

U.S. PATENT DOCUMENTS

| | | | | |
|---|---|---|---|---|
| 4,804,610 | A | 2/1989 | Mori et al. | |
| 4,816,366 | A | 3/1989 | Hyosu et al. | |
| 4,845,007 | A | 7/1989 | Hyosu et al. | |
| 4,904,562 | A | 2/1990 | Yusa et al. | |
| 4,912,010 | A | 3/1990 | Mori et al. | |
| 4,960,669 | A | 10/1990 | Mori et al. | |
| 5,116,712 | A | 5/1992 | Nakamura et al. | |
| 5,130,219 | A | 7/1992 | Mori et al. | |
| 5,130,220 | A | 7/1992 | Nakamura et al. | |
| 5,143,812 | A | 9/1992 | Mori et al. | |
| 5,166,032 | A | 11/1992 | Nakamura et al. | |
| 5,169,738 | A | 12/1992 | Tanikawa et al. | |
| 5,212,524 | A | 5/1993 | Tanikawa et al. | |
| 5,213,933 | A | 5/1993 | Osaki et al. | |
| 5,215,854 | A | 6/1993 | Yamazaki et al. | |
| 5,219,697 | A | 6/1993 | Mori et al. | |
| 5,268,248 | A | 12/1993 | Tanikawa et al. | |
| 5,296,326 | A | 3/1994 | Taya et al. | |
| 5,330,871 | A | 7/1994 | Tanikawa et al. | |
| 5,338,894 | A | 8/1994 | Uchiyama et al. | |
| 5,348,829 | A | 9/1994 | Uchiyama et al. | |
| 5,354,637 | A | 10/1994 | Shimamura et al. | |
| 5,480,755 | A | 1/1996 | Uchiyama et al. | |
| 5,500,318 | A | 3/1996 | Tanikawa et al. | |
| 5,504,272 | A | 4/1996 | Uchiyama et al. | |
| 5,641,600 | A | 6/1997 | Kotaki et al. | |
| 5,716,746 | A | 2/1998 | Mikuriya et al. | |
| 5,998,008 | A | 12/1999 | Shimamura et al. | |
| 6,122,473 | A | 9/2000 | Goseki et al. | |
| 6,214,509 | B1 | 4/2001 | Kasuya et al. | |
| 6,430,384 | B2 * | 8/2002 | Hama et al. | 399/276 |
| 6,447,969 | B1 | 9/2002 | Ito et al. | |
| 6,555,281 | B1 | 4/2003 | Nozawa et al. | |
| 6,610,454 | B2 | 8/2003 | Hashimoto et al. | |
| 6,632,577 | B2 | 10/2003 | Akashi et al. | |
| 6,687,476 | B2 * | 2/2004 | Goseki et al. | 399/109 |
| 6,706,458 | B2 | 3/2004 | Nozawa et al. | |
| 6,855,471 | B2 | 2/2005 | Katsuta et al. | |
| 6,897,001 | B2 | 5/2005 | Mizoe et al. | |
| 6,972,166 | B2 | 12/2005 | Nozawa et al. | |
| 7,097,952 | B2 | 8/2006 | Nozawa et al. | |
| 7,361,400 | B2 | 4/2008 | Shimamura et al. | |
| 7,361,442 | B2 | 4/2008 | Otake et al. | |
| 7,796,926 | B2 | 9/2010 | Matsuda et al. | |
| 8,298,658 | B2 | 10/2012 | Shimamura et al. | |

(56) References Cited

FOREIGN PATENT DOCUMENTS

| | | | |
|---|---|---|---|
| JP | 11-125966 | A | 5/1999 |
| JP | 3740274 | B2 | 2/2006 |
| JP | 2010-8878 | A | 1/2010 |
| JP | 2011-95625 | A | 5/2011 |
| JP | 2011-128263 | A | 6/2011 |
| JP | 2011-128264 | A | 6/2011 |

OTHER PUBLICATIONS

PCT International Search Report and Written Opinion of the International Searching Authority, International Application No. PCT/JP2012/004916, Mailing Date Sep. 18, 2012.

* cited by examiner

*Primary Examiner* — Hoang Ngo
(74) *Attorney, Agent, or Firm* — Fitzpatrick, Cella, Harper & Scinto

(57) ABSTRACT

A developer carrying member having less environmental dependence is provided. The developer carrying member has a substrate and a resin layer, which resin layer contains an acrylic resin; the acrylic resin having a unit (1) represented by the following formula (1) and a unit (2) represented by the following formula (2). In the formula (1), $R_1$ represents a hydrogen atom or a methyl group, $R_2$ represents an alkylene group having 1 to 4 carbon atoms, and an asterisk * represents the part of linkage to the part shown by a double asterisk ** in the formula (2). In the formula (2), $R_3$ represents a hydrogen atom or a methyl group; $R_4$ represents an alkylene group having 1 to 4 carbon atom(s); $R_5$, $R_6$ and $R_7$ each represent an alkyl group having 1 to 18 carbon atoms; $A^-$ represents an anion.

(1)

(2)

10 Claims, 3 Drawing Sheets

DEVELOPER CARRYING MEMBER, METHOD FOR ITS PRODUCTION, AND DEVELOPING ASSEMBLY

CROSS-REFERENCE TO RELATED APPLICATIONS

This application is a continuation of International Application No. PCT/JP2012/004916, filed Aug. 2, 2012, which claims the benefit of Japanese Patent Application No. 2011-170042, filed Aug. 3, 2011.

BACKGROUND OF THE INVENTION

1. Field of the Invention

This invention relates to a developer carrying member used in an electrophotographic apparatus, a method for its production, and a developing assembly.

2. Description of the Related Art

In order that developers (toners) used to form electrophotographic images are provided with proper triboelectricity, Japanese Patent No. 03740274 proposes a developer carrying member comprising a substrate and provided thereon a resin layer containing as a binder resin a copolymer which contains a quaternary ammonium base.

SUMMARY OF THE INVENTION

However, as a result of studies made by the present inventors, it has been found that, where the developer carrying member according to Japanese Patent No. 03740274 is used, image density decreases depending on its service environments, and the image density decreases especially when it is left to stand in a high-temperature and high-humidity environment for a long period, to cause a difference in image density from that in a low-temperature and low-humidity environment.

Accordingly, the present invention is directed to providing a developer carrying member which has a superior triboelectricity-providing ability to toners and also may less cause any change in image density depending on its service environments, and provide a method for its production. Further, the present invention is directed to providing a developing assembly which can stably form high-grade electrophotographic images.

According to one aspect of the present invention, there is provided a developer carrying assembly comprising a substrate and a resin layer containing an acrylic resin; wherein the acrylic resin has a unit (1) represented by the following formula (1), and a unit (2) represented by the following formula (2).

(1)

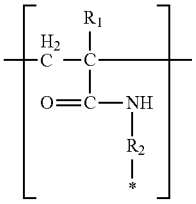

In the formula (1), $R_1$ represents a hydrogen atom or a methyl group, $R_2$ represents an alkylene group having 1 to 4 carbon atoms, and an asterisk * represents the part of linkage to the part shown by a double asterisk ** in the formula (2).

(2)

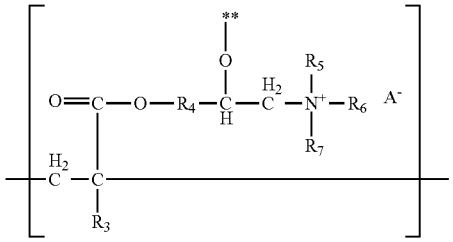

In the formula (2), $R_3$ represents a hydrogen atom or a methyl group; $R_4$ represents an alkylene group having 1 to 4 carbon atom(s); $R_5$, $R_6$ and $R_7$ each represent an alkyl group having 1 to 18 carbon atoms; $A^-$ represents an anion; and a double asterisk ** represents the part of linkage to the part shown by an asterisk * in the formula (1).

According to another aspect of the present invention, there is provided a method for producing a developer carrying member comprising a substrate and a resin layer containing an acrylic resin, comprising a step of obtaining the acrylic resin through a reaction comprising the following polymerization reactions A and B: Polymerization reaction A: Radical polymerization reaction between monomers selected from a monomer (3) represented by the following formula (3) and a monomer (4) represented by the following formula (4); and Polymerization reaction B: Dehydration polycondensation reaction of the hydroxyl group of the monomer (3) and the hydroxyl group of the monomer (4).

(3)

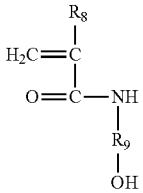

In the formula (3), $R_8$ represents a hydrogen atom or a methyl group, and $R_9$ represents an alkylene group having 1 to 4 carbon atoms.

(4)

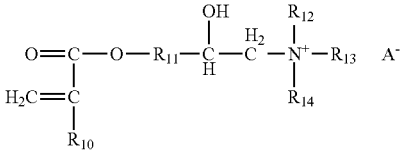

In the formula (4), $R_{10}$ represents a hydrogen atom or a methyl group; $R_{11}$ represents an alkylene group having 1 to 4 carbon atom(s); $R_{12}$, $R_{13}$ and $R_{14}$ each independently represent an alkyl group having 1 to 18 carbon atoms; and $A^-$ represents an anion.

The developing assembly according to the present invention is a developing assembly which comprises a negatively triboelectrically chargeable developer having toner particles, a container holding the developer therein, a developer carrying member for carrying and transporting thereon the developer held in the container, and a developer layer thickness control member, and which transports, while forming a developer layer on the developer carrying member by means of the developer layer thickness control member, the developer on the developer carrying member to a developing zone facing an electrostatic latent image bearing member, and develops an electrostatic latent image the electrostatic latent image bearing member has, to form a toner image thereon; the developer carrying member being the above developer carrying member.

According to the present invention, a developer carrying member and a developing assembly are provided which have a high triboelectricity-providing ability to developers and also have less environmental dependence of image density.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
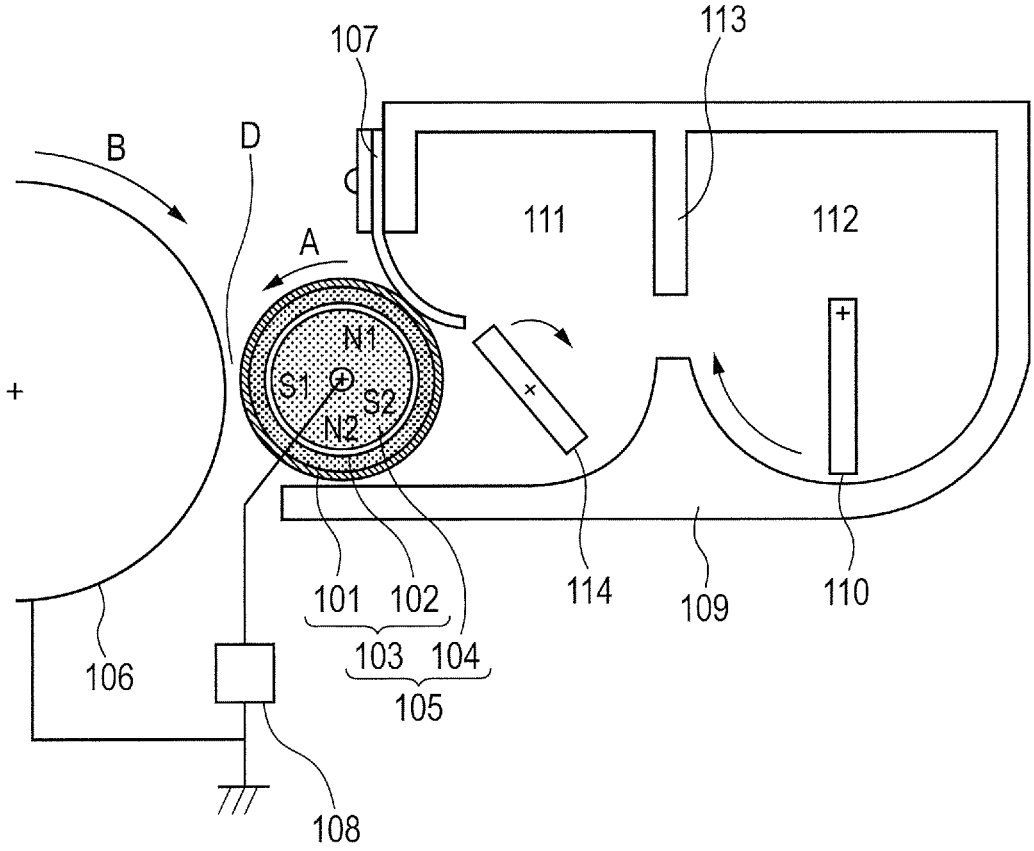
FIG. 1 is a sectional view showing an embodiment of the developing assembly according to the present invention.

The developer carrying member according to the present invention has, as shown in FIG. 1, a substrate 102 and a resin layer 101 formed on the peripheral surface of the substrate 102. The resin layer 101 contains an acrylic resin having two units which has specific structures.

Acrylic Resin:

The acrylic resin according to the present invention has the function to improve the triboelectric charge quantity of a negatively triboelectrically chargeable developer. Further, inasmuch as the acrylic resin has a specific cross-linked structure, it can be kept from being affected by humidity. As the result, it can contribute to a high image density without regard to any service environments. The acrylic resin that brings such an effect has a unit represented by the following formula (1) (hereinafter also termed "unit (1)") and a unit represented by the following formula (2) (hereinafter also termed "unit (2)").

(1)

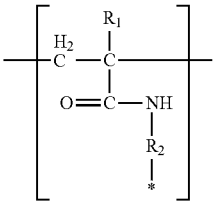

In the formula (1), $R_1$ represents a hydrogen atom or a methyl group, $R_2$ represents an alkylene group having 1 to 4 carbon atoms, and an asterisk * represents the part of linkage to the part shown by a double asterisk ** in the formula (2).

(2)

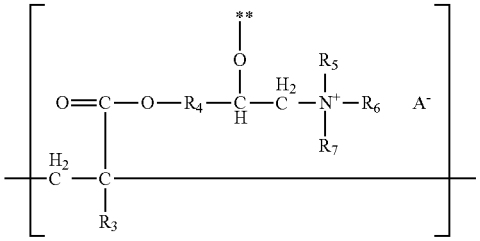

In the formula (2), $R_3$ represents a hydrogen atom or a methyl group; $R_4$ represents an alkylene group having 1 to 4 carbon atom(s); $R_5$, $R_6$ and $R_7$ each represent an alkyl group having 1 to 18 carbon atoms; $A^-$ represents an anion; and a double asterisk ** represents the part of linkage to the part shown by an asterisk * in the formula (1).

The unit (1) and unit (2) stand mutually chemically linked at their side chains to have been three-dimensionally cross-linked. This brings an improvement in environmental stability of image density where this acrylic resin is used in the resin layer of the developer carrying member.

The reason why the above effect is obtained by the three-dimensional cross-linking of the unit (1) and unit (2) at the specific part of linking is still theoretically unclear, and this is presumed as stated below.

The respective units stand thermal motion in the acrylic resin, and come higher in motion as their side chains are larger in length. The unit (2) has the part of linking in the vicinity of a quaternary ammonium base, and hence the quaternary ammonium base is kept from coming into motion. The quaternary ammonium base tends to absorb water molecules, and hence the quaternary ammonium base is kept from coming into motion, so that the acrylic resin has less opportunity to come into contact with any moisture present in the atmosphere, thus the moisture is kept from its absorption in the resin layer. As the result, the developer carrying member of the present invention can not easily be affected by environmental moisture and shows a good environmental stability, as so considered. Also, the above motion is accelerated as environments have higher temperature, whereas the acrylic resin the quaternary ammonium base of which has been kept from coming into motion can not easily be affected by temperatures, thus the developer carrying member of the present invention shows a good environmental stability, as so considered.

The unit (2) contributes to improvement in the triboelectric charge quantity of a negatively triboelectrically chargeable developer the developer carrying member holds. $R_5$, $R_6$ and $R_7$ in the formula (2) are each an alkyl group having 1 to 18 carbon atoms. Inasmuch as they are each an alkyl group having 1 to 18 carbon atoms, the acrylic resin is kept from being crystallizable, and comes improved in compatibility with solvents. Accordingly, in order to obtain a uniform resin layer, $R_5$, $R_6$ and $R_7$ are each set to be an alkyl group having 1 to 18 carbon atoms. At least one alkyl group selected from $R_5$, $R_6$ and $R_7$ in the formula (2) may be a long-chain alkyl group having 8 to 18 carbon atoms. This is preferable because the developer carrying member can be more improved in its triboelectricity-providing ability.

$A^-$ in the formula (2) is an anion in halogens, in inorganic acids such as hydrochloric acid, hydrobromic acid, sulfuric acid, phosphoric acid and nitric acid, and in organic acids such as carboxylic acids and sulfonic acids. $A^-$ may much preferably be a methylsulfonate ion or a p-toluenesulfonate ion in order to further improve the triboelectric charge quantity of a negatively triboelectrically chargeable developer.

In order to better control the triboelectricity-providing ability of the above acrylic resin, the acrylic resin may contain, in addition to the above unit (1) and unit (2), another unit represented by the following formula (5) (hereinafter also termed "unit (5)").

(5)

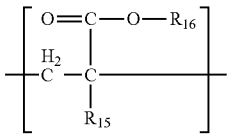

In the formula (5), $R_{15}$ represents a hydrogen atom or a methyl group, and $R_{16}$ represents an alkyl group having 1 to 18 carbon atoms.

The acrylic resin usable in the present invention may be produced by (A) radical polymerization reaction of a hydroxyl-group-modified acrylic monomer with an acrylic monomer having a quaternary ammonium base and (B) dehydration polycondensation reaction between hydroxyl groups.

The hydroxyl-group-modified acrylic monomer may include a monomer (3) represented by the following formula (3).

(3)

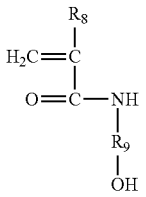

In the formula (3), $R_8$ represents a hydrogen atom or a methyl group, and $R_9$ represents an alkylene group having 1 to 4 carbon atoms. Of what is represented by the formula (3), N-methylol acrylamide or N-ethylol acrylamide is preferable in view of the controlling of the reaction.

The acrylic monomer having a quaternary ammonium base may include a monomer (4) represented by the following formula (4).

(4)

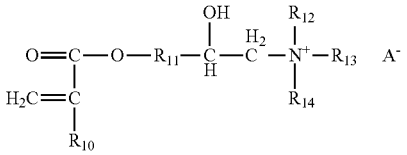

In the formula (4), $R_{10}$ represents a hydrogen atom or a methyl group; $R_{11}$ represents an alkylene group having 1 to 4 carbon atom(s); $R_{12}$, $R_{13}$ and $R_{14}$ each independently represent an alkyl group having 1 to 18 carbon atoms; and $A^-$ represents an anion.

$R_{12}$, $R_{13}$ and $R_{14}$ in the formula (4) are each an alkyl group having 1 to 18 carbon atoms. Inasmuch as they are each an alkyl group having not more than 18 carbon atoms, the acrylic resin is kept from being crystallizable, and comes improved in compatibility with solvents. Inasmuch as it is improved in such compatibility, the resin layer can uniformly be formed when the developer carrying member is made up, and makes it easy to control the triboelectricity-providing ability uniformly. Accordingly, in view of readiness to produce the acrylic resin, $R_{12}$, $R_{13}$ and $R_{14}$ are each set to be an alkyl group having 1 to 18 carbon atoms. In the case of a monomer in which at least one alkyl group among $R_{12}$, $R_{13}$ and $R_{14}$ in the formula (4) is a long-chain alkyl group having 8 to 18 carbon atoms, the resin layer can more improve the triboelectric charge quantity of a negatively triboelectrically chargeable developer, thus such a monomer is much preferred.

Polymerization Reaction:

The acrylic resin in the present invention may be obtained with ease by carrying out the following polymerization reactions using the above monomer (3) and monomer (4).

Polymerization reaction A: Radical polymerization reaction between monomers selected from the monomer (3) and the monomer (4); and Polymerization reaction B: Dehydration polycondensation reaction of the hydroxyl group of the monomer (3) and the hydroxyl group of the monomer (4).

The radical polymerization reaction A and the dehydration polycondensation reaction B between hydroxyl groups may be carried out simultaneously, but it is preferable to carry out the dehydration polycondensation reaction B between hydroxyl groups after the radical polymerization reaction A, because any residual monomers can be made less in quantity.

As the radical polymerization reaction A, any known polymerization process such as bulk polymerization, suspension polymerization or emulsion polymerization may be used. In particular, solution polymerization is preferable in view of an advantage that the reaction can be controlled with ease.

As a solvent used in the solution polymerization, what is capable of dissolving the acrylic resin uniformly is suited, and preferred is a lower alcohol such as methanol, ethanol, n-butanol or isopropyl alcohol. Inasmuch as it is such a lower alcohol, a coating material for forming the resin layer can have a low viscosity when it is prepared, easily promising good film-forming properties for the resin layer. Any other solvent may also optionally be mixed when used.

As the ratio of the solvent to the monomer components, which are used in the solution polymerization, the polymerization may preferably be carried out using 25 parts by mass or more to 400 parts by mass or less of the solvent, based on 100 parts by mass of the monomer components. This is preferable in order to control the product to have an appropriate viscosity.

The polymerization of a monomer mixture may be carried out by, e.g., heating the monomer mixture in the presence of a polymerization initiator, in an atmosphere of an inert gas and at a temperature of from 50° C. or more to 100° C. or less. The polymerization initiator may include the following: t-Butyl peroxy-2-ethylhexanoate, cumyl perpivarate, t-butyl peroxylaurate, benzoyl peroxide, lauroyl peroxide, octanoyl peroxide, di-t-butyl peroxide, t-butylcumyl peroxide, dicumyl peroxide, 2,2'-azobisisobutyronitrile, 2,2'-azobis-(2-methylbutyronitrile), 2,2'-azobis(2,4-dimethylvaleronitrile), 2,2'-azobis(4-methoxy-2,4-dimethylvaleronitrile), and dimethyl 2,2'-azobis(2-methyl propionate).

The polymerization initiator may be used alone or in combination of two or more types. Usually, the polymerization is initiated with addition of the polymerization initiator to a monomer solution. However, in order to make any unreacted monomers less remain, part of the polymerization initiator may be added on the way of the polymerization. A method may also be employed in which the polymerization is accelerated by irradiation with ultraviolet rays or electron rays. These methods may also be combined.

The polymerization initiator may preferably be used in an amount of from 0.05 part by mass or more to 30 parts by mass or less, and particularly from 0.1 part by mass or more to 15 parts by mass or less, based on 100 parts by mass of the monomer components. Setting within this range the amount of the polymerization initiator to be used enables reduction of any residual monomers and facilitates the controlling of molecular weight of the acrylic resin. As temperature of the polymerization reaction, it may be set in accordance with the solvent, polymerization initiator and monomer components to be used. The reaction may be carried out at a temperature of from 40° C. or more to 150° C. or less, and this is preferable in view of stable progress of the polymerization reaction.

As the monomer (4), a monomer may be used which has been formed by subjecting a glycidyl group-containing ester monomer (6) represented by the following formula (6), to ring-opening reaction with a quaternary ammonium salt represented by the following formula (7).

(6)

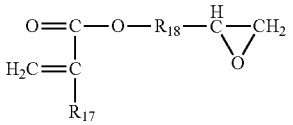

(7)

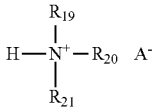

In the formula (6), $R_{17}$ represents a hydrogen atom or a methyl group, and $R_{18}$ represents an alkylene group having 1 to 4 carbon atom(s). In the formula (7), $R_{19}$, $R_{20}$ and $R_{21}$ each represent an alkyl group having 1 to 18 carbon atom(s), and $A^-$ represents an anion.

The reaction of these monomers may be carried out by, e.g., heating the glycidyl group-containing ester monomer and the quaternary ammonium salt in a solvent at a temperature of from 50° C. or more to 120° C. or less.

A monomer may also be used which has been formed by allowing the formula-(6) monomer to react with an organic amine in the presence of an acid component.

The organic amine may include the following: Tertiary amines such as trimethylamine, triethylamine, trioctylamine, dimethylbutylamine, dimethyloctylamine, dimethyllaurylamine, dimethylstearylamine, dilaurylmonomethylamine and dimethylbehenylamine; and secondary amines such as dimethylamine, diethylamine, methylbutylamine, methyloctylamine, methyllaurylamine and methylstearylamine.

The acid component may include the following: Hydrogen halides such as hydrogen bromide and hydrogen chloride; alkyl halides such as methyl bromide, methyl chloride, butyl bromide, butyl chloride, octyl bromide, octyl chloride, lauryl bromide, lauryl chloride, octadecyl bromide and octadecyl chloride; and organic acids such as methylsulfonic acid and p-toluenesulfonic acid.

As the dehydration polycondensation reaction B between hydroxyl groups, an acrylic resin solution obtained by radical polymerization reaction carried out by the above solution polymerization may be heated at a temperature of from 100° C. or more to 160° C. or less, whereby the reaction can be carried out simultaneously with the vaporization of the solvent. An acid catalyst such as p-toluenesulfonic acid or hydroxynaphthalenesulfonic acid may also be used, and this is preferable because the reaction can be controlled with ease. Here, if the dehydration polycondensation reaction B between hydroxyl groups proceeds in excess before the substrate is coated thereon with a coating material containing the acrylic resin solution, the acrylic resin may cross-link to make it difficult for the resin layer to be uniformly formed. Hence, it is preferable for the coating material to be heated after it has been applied onto the substrate.

In order to control the charge-providing ability of the acrylic resin, or in order to control the solubility of the acrylic resin in the solvent, a monomer other than the foregoing may also be used at the time of the radical polymerization. Such other monomer may include a monomer (8) represented by the following formula (8).

(8)

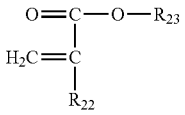

In the formula (8), $R_{22}$ represents a hydrogen atom or a methyl group, and $R_{23}$ represents an alkyl group having 1 to 18 carbon atom(s). The number of carbon atoms of $R_{23}$ in the formula (8) may appropriately be set in order to control the solubility of the acrylic resin in the solvent.

The respective monomers for producing the above acrylic resin may preferably be in such a compositional proportion that, where the number of moles of the monomer (3) is represented by a (mole), the number of moles of the monomer (4) by b (mole), and the number of moles of the monomer (8) by c (mole), the value of a/(a+b+c) is from 0.4 or more to 0.8 or less, the value of b/(a+b+c) is from 0.2 or more to 0.6 or less and the value of c/(a+b+c) is from 0.0 or more to 0.4 or less.

Inasmuch as the value of a/(a+b+c) is 0.4 or more, the reaction between the monomer (3) and the monomer (4) accelerates to make it easy to improve the environmental stability of image density. Inasmuch as the value of b/(a+b+c) is 0.2 or more, the triboelectricity-providing ability to a negatively triboelectrically chargeable developer is improved when the developer carrying member is made up, to make it easy to improve the triboelectric charge quantity of the negatively triboelectrically chargeable developer.

Inasmuch as the value of a/(a+b+c) is 0.8 or less and the value of b/(a+b+c) is 0.6 or less, the above effect attributable to the introduction of the monomer (3) and monomer (4) can be obtained with ease. Further, inasmuch as the value of c/(a+b+c) is 0.4 or less, the above effect attributable to the introduction of the monomer (3) and monomer (4) can also be obtained with ease.

Incidentally, in the above compositional proportion, where the monomer (3) is contained in the acrylic resin in a plurality of kinds, the total number of moles in a compositional ratio of a plurality of kinds of units that satisfy the structure of the monomer (3) is represented by a (mole). Also, where the monomer (4) is contained in the acrylic resin in a plurality of kinds, the total number of moles in a compositional ratio of a plurality of kinds of units that satisfy the structure of the monomer (4) is represented by b (mole). Further, where the monomer (8) is contained in the acrylic resin in a plurality of kinds, the total number of moles in a compositional ratio of a plurality of kinds of units that satisfy the structure of the monomer (8) is represented by c (mole).

Volume Resistivity of Resin Layer:

In the present invention, in order to control the volume resistivity of the resin layer, the resin layer may preferably be incorporated therein with conductive particles. Such conductive particles may include particles of metals, metal oxides and carbides such as carbon black and graphite. The resin layer may preferably have a volume resistivity of approximately $10^4$ Ω·cm or less, and particularly from $10^{-3}$ Ω·cm or more to $10^3$ Ω·cm or less.

Surface Roughness of Resin Layer:

The resin layer may preferably have, as its surface roughness, an arithmetic-mean roughness Ra (JIS B 0601-2001) of approximately from 0.3 μm to 2.5 μm. As a method by which the surface roughness of the resin layer is controlled to the desired value, a method is available in which the substrate on which the resin layer is to be formed is sand-blasted to provide it with surface roughness and the resin layer is formed thereon, or a method in which the resin layer is incorporated with unevenness-providing particles.

How to Produce Resin Layer:

How to produce the resin layer is described next. The resin layer may be formed through, e.g., the following steps.

(1) The step of subjecting the monomers to radical polymerization to prepare an acrylic resin solution;

(2) the step of applying the acrylic resin solution onto the substrate; and (3) the step of drying to harden, or curing, a wet coating formed by coating on the substrate.

As a method for the radical polymerization (polymerization reaction A) in the step (1), the solution polymerization described above is preferred.

As a method for applying the acrylic resin solution onto the substrate in the step (2), a known method such as dipping, spraying or roll coating may be used. In order to make uniform the components in the resin layer, spaying is preferred.

For the drying to harden or the curing in the step (3), a known heating unit such as a heat dryer or an infrared heater may preferably be used. By this step, the dehydration polycondensation reaction between hydroxyl groups of the monomers (polymerization reaction B) take places. Also, when the wet coating is dried to harden, or cured, it may be treated at a temperature of from 100° C. or more to 160° C. or less, and this is preferable in carrying out the polymerization reaction B.

Where other material such as conductive particles or unevenness-providing particles is used in order to control the volume resistivity and surface roughness of the resin layer, a step (4) shown below may preferably be carried out between the step (1) and the step (2).

(4) The step of dispersing and mixing the acrylic resin solution and such other material to make them into a coating material.

To disperse and mix the materials in the step (4), a known dispersion machine that utilizes beads may preferably be used, as exemplified by a sand mill, a paint shaker, Daino mill or Pearl mill.

The resin layer may also preferably have a layer thickness of 50 μm or less, much preferably 40 μm or less, and further preferably from 4 μm to 30 μm or less, because it is easy to form the layer in a uniform layer thickness.

Substrate:

The substrate may include a cylindrical member, a columnar member or a belt-shaped member. A material for the substrate may include non-magnetic metals or alloys such as aluminum, stainless steel or brass. What is obtained by forming a rubber layer or resin layer on the substrate may also be used as the substrate.

Developing Assembly:

The developing assembly according to the present invention has a negatively triboelectrically chargeable developer having toner particles, a container holding the developer therein, a developer carrying member for carrying and transporting thereon the developer held in the container, and a developer layer thickness control member. Then the developing assembly transports, while forming a developer layer on the developer carrying member by means of the developer layer thickness control member, the developer on the developer carrying member to a developing zone facing an electrostatic latent image bearing member and develops an electrostatic latent image the electrostatic latent image bearing member has, to form a toner image thereon. Then, the developer carrying member is the developer carrying member according to the present invention as described above.

The developing assembly according to the present invention may be used in any of a non-contact developing assembly and a contact developing assembly which make use of a magnetic one-component developer or non-magnetic one-component developer and a developing assembly making use of a two-component developer. In particular, the developing assembly of the present invention may particularly preferably be used in the non-contact developing assembly making use of the magnetic one-component developer or non-magnetic one-component developer, which has a tendency to easily cause non-uniformity in triboelectric charge quantity of the developer on the developer carrying member.

FIG. 1 is a sectional view of a magnetic one-component non-contact developing assembly according to the present invention. It has a container (developer container 109) for holding a developer therein and a developer carrying member 105 for carrying and transporting thereon a magnetic one-component developer (not shown) (a magnetic toner) having magnetic toner particles, held in the container. The developer carrying member 105 is provided with a developing sleeve 103 having a metal cylindrical tube that is a substrate 102 and provided thereon a resin layer 101. Also, inside the developing sleeve, a magnet (a magnet roller) 104 is provided so that the magnetic toner can magnetically be held on the sleeve surface.

Meanwhile, a photosensitive drum 106 holding thereon an electrostatic latent image is rotated in the direction of an arrow B. Then, in a developing zone D where the developer carrying member 105 and the photosensitive drum 106 face each other, the magnetic toner on the developer carrying member 105 is caused to adhere to the electrostatic latent image so that a magnetic toner image may be formed.

A developing method making use of such a developing assembly is described below.

The developer container 109 is divided into a first chamber 112 and a second chamber 111, where the magnetic toner filled in the first chamber 112 is sent to the second chamber 111 by the aid of an agitating transport member 110, passing through an opening formed by the developer container 109 and a partition member 113. The second chamber 111 is provided therein with an agitating member 114, which prevents the magnetic toner from stagnating.

The developer container is provided with an elastic blade 107 as the developer layer thickness control member, which is formed of an elastic plate having an elastic sheet made of a rubber such as urethane rubber or silicone rubber, or made of a metal such as bronze or stainless steel. This elastic blade 107 is brought into contact with, or pressed against, the developer carrying member 105 through the toner between them, and the toner is formed in a thin layer on the developer carrying member 105, undergoing a stronger control than a non-contact developing assembly shown in FIG. 2.

In the developing assembly of this type, the toner tends to be influenced by the triboelectricity-providing ability of the developer carrying member surface, and the triboelectric charge quantity of the toner held on the developer carrying member tends to come non-uniform. Even in such a developing assembly, however, the use of the developer carrying member of the present invention enables achievement of a high triboelectricity-providing ability for the negatively triboelectrically chargeable developer and achievement of a high image density without regard to any service environments.

Here, the elastic blade 107 may be pressed against the developer carrying member 105 at a touch pressure of from 4.9 N/m or more to 49 N/m or less as linear pressure. This is preferable in view of an advantage that the thickness of the toner layer can preferably be controlled. Inasmuch as the elastic blade 107 is set at a touch pressure of 4.9 N/m or more as linear pressure, the thickness of the toner layer to be formed on the developer carrying member can be controlled in a high precision, and any fog or toner leak can be kept from occurring in the images to be obtained. Also, inasmuch as it is 49 N/m or less in linear pressure, the toner can have an appropriate rubbing force, and the toner can be prevented from deteriorating and from melt-sticking to the developer carrying member 105 and the elastic blade 107.

In order to cause the magnetic toner carried on the developer carrying member 105, to fly to the electrostatic latent image formed on the photosensitive drum to develop this latent image, a development bias voltage may preferably be applied to the developer carrying member 105 from a development bias power source 108.

When a direct-current voltage is used as the development bias voltage to be applied to the developer carrying member 105, a voltage is preferable which corresponds to a value intermediate between the potential at electrostatic latent image areas and the potential at back ground areas. In order to enhance the density of the images to be developed or improve the gradation thereof, an alternating bias voltage may be applied to the developer carrying member 105 to form in the developing zone D a vibrating electric field whose direction alternately reverses. In such a case, too, an alternating bias voltage formed by superimposing thereon a direct-current voltage component corresponding to a value intermediate between the potential at electrostatic latent image areas and the potential at back ground areas is preferable as the voltage to be applied to the developer carrying member 105.

Here, in the case of regular development, where the magnetic toner is attracted to an electrostatic latent image having high potential, a magnetic toner triboelectrically chargeable to a polarity reverse to the polarity of the electrostatic latent image is used. In the case of reverse development, where the magnetic toner is attracted to an electrostatic latent image having low potential, a magnetic toner chargeable to the same polarity as the polarity of the electrostatic latent image is used. What is herein meant by the high potential or the low potential is expression made by the absolute value.

The above example is the non-contact developing assembly making use of a magnetic one-component developer. The developing assembly of the present invention, however, may also be used in a contact developing assembly, in which the developer layer on the developer carrying member is formed in a thickness larger than the distance between the developer carrying member and the photosensitive drum in the developing zone D.

Figure 2:
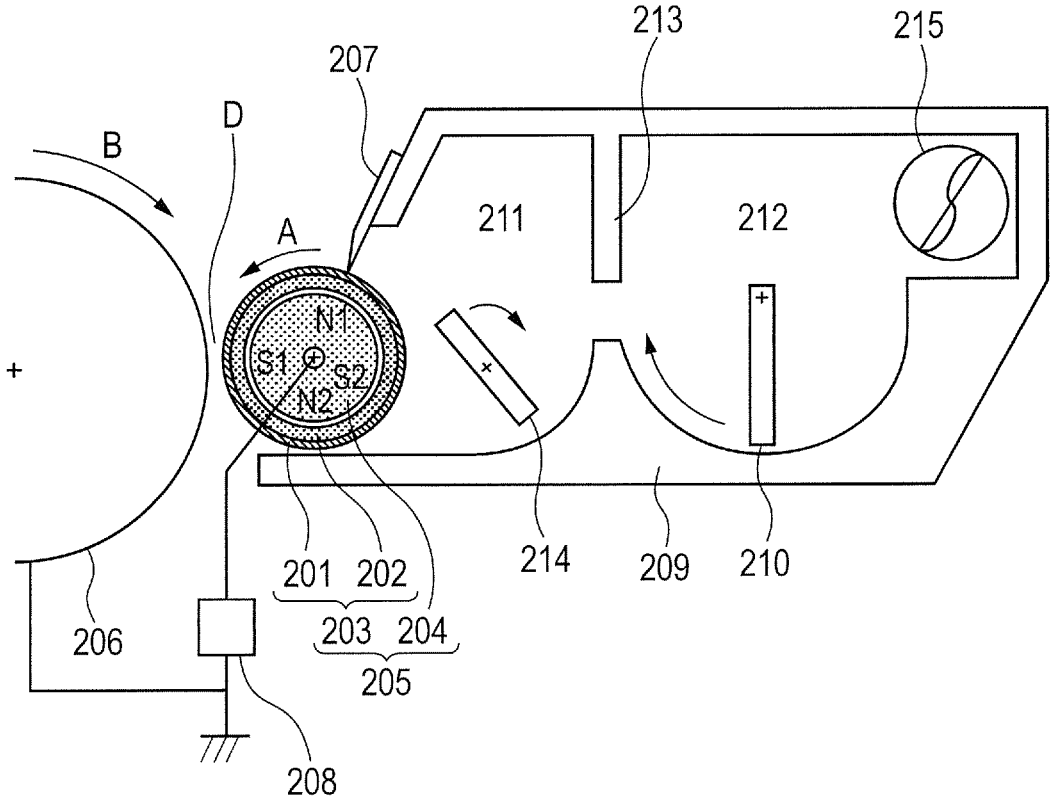
FIG. 2 is a sectional view showing another embodiment of the developing assembly according to the present invention.

FIG. 2 is a sectional view of another example of the non-contact developing assembly making use of a magnetic one-component developer, according to the present invention. It has a container (developer container 209) for holding a developer therein and a developer carrying member 205 for carrying and transporting thereon a magnetic one-component developer (not shown) (a magnetic toner) having magnetic toner particles, held in the container. The developer carrying member 205 is provided with a developing sleeve 203 having a metal cylindrical tube that is a substrate 202 and provided thereon a resin layer 201. Also, inside the developing sleeve, a magnet (a magnet roller) 204 is provided so that the magnetic toner can magnetically be held on the sleeve surface.

Meanwhile, an electrostatic latent image bearing member (e.g., a photosensitive drum) 206 holding thereon an electrostatic latent image is rotated in the direction of an arrow B. Then, in a developing zone D where the developer carrying member 205 and the photosensitive drum 206 face each other, the magnetic toner on the developer carrying member 205 is caused to adhere to the electrostatic latent image so that a magnetic toner image may be formed.

A developing method in such a developing assembly is described below.

The magnetic toner is sent into the developer container 209 from a developer supply container (not shown) via a developer feed member (such as a screw) 215. The developer container 209 is divided into a first chamber 212 and a second chamber 211, where the magnetic toner having been sent into the first chamber 212 is sent to the second chamber 211 by the aid of an agitating transport member 210, passing through an opening formed by the developer container 209 and a partition member 213. The second chamber 211 is provided therein with an agitating member 214, which prevents the magnetic toner from stagnating.

The developer container is fitted with a magnetic blade 207, the developer layer thickness control member, in such a way as to face the developer carrying member 205 leaving a gap of from about 50 μm or more to about 500 μm or less between them. The magnetic line of force exerted from a magnetic pole N1 of the magnet roller 204 is converged to the gap at the magnetic blade, where the developer carrying member is rotated in the direction of an arrow A to form on the developer carrying member 205 a thin layer of the magnetic toner. Incidentally, a non-magnetic developer layer thickness control member may also be used in place of the magnetic blade 207.

The magnetic toner gains triboelectric charges which enable development of the electrostatic latent image formed on the photosensitive drum 206, as a result of the friction between toner particles one another and between the magnetic toner and the resin layer 201 at the surface of the developer carrying member 205. The thickness of the magnetic toner thin layer thus formed on the developer carrying member 205 may preferably be much smaller than the minimum gap between the developer carrying member 205 and the photosensitive drum 206 in the developing zone D.

In order to cause the magnetic toner carried on the developer carrying member 205, to fly to the electrostatic latent image formed on the photosensitive drum to develop this latent image, a development bias voltage may preferably be applied to the developer carrying member 205 from a development bias power source 208.

Figure 3:
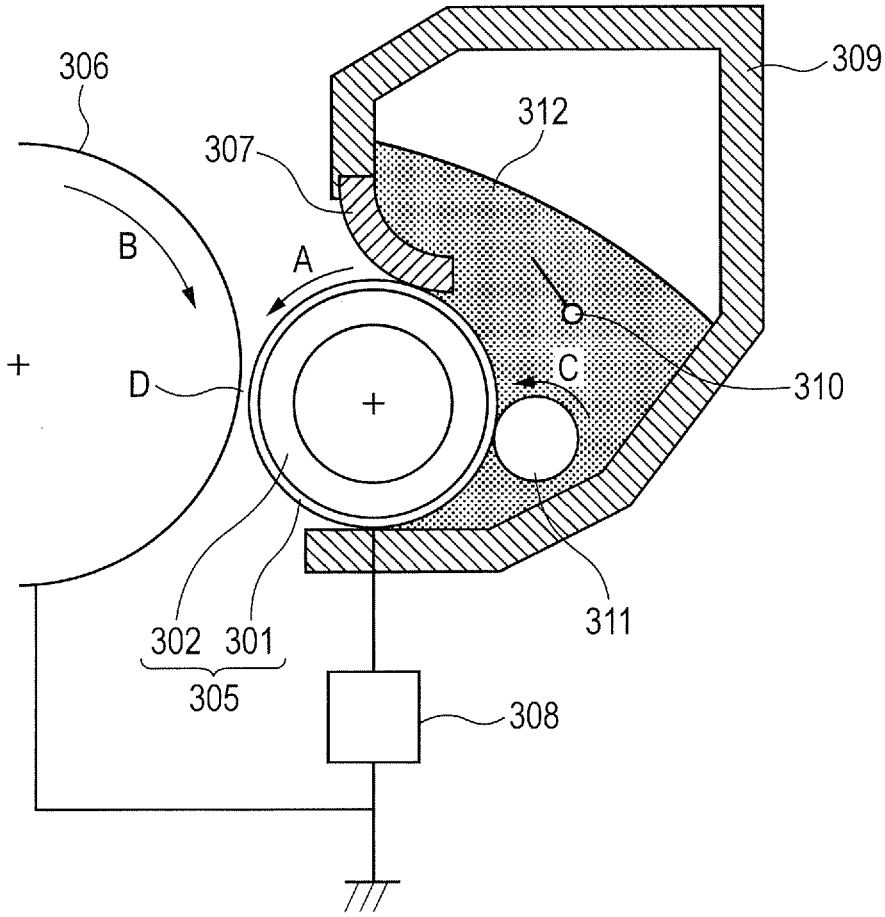
FIG. 3 is a sectional view showing still another embodiment of the developing assembly according to the present invention.

FIG. 3 is a sectional view of a non-magnetic one-component non-contact developing assembly, which uses a non-magnetic toner, according to the present invention. A photosensitive drum 306 carrying an electrostatic latent image thereon is rotated in the direction of an arrow B. A developer carrying member 305 is constituted of a substrate (a cylindrical tube made of a metal) 302 and a resin layer 301 formed on its surface. As the substrate, a columnar member may also be used in place of the cylindrical tube made of a metal, where a non-magnetic one-component developer (non-magnetic toner) is used, and hence the substrate 302 is not internally provided therein with any magnet.

A developing method making use of the developing assembly described above is described below.

A developer container 309 is provided therein with an agitating transport member 310 for agitating and transporting a non-magnetic one-component developer 312 (a non-magnetic toner). The developer container is further provided therein with a developer feeding and stripping member (RS roller) 311 in contact with the developer carrying member 305, which member is to feed the non-magnetic toner 312 to the developer carrying member 305 and also strip off any non-magnetic toner 312 remaining on the surface of the developer carrying member 305 after development.

The RS roller 311 is rotated in the same direction as or in the opposite direction to that of the developer carrying member 305 to thereby strips off, inside the developer container 309, any non-magnetic toner 312 remaining on the developer carrying member 305 and feeds thereto a fresh non-magnetic toner 312. The developer carrying member 305 carries thereon the non-magnetic toner 312 thus fed and is rotated in the direction of an arrow A to thereby transport the non-magnetic toner to a developing zone D where the developer carrying member 305 and the photosensitive drum 306 face each other.

The non-magnetic toner carried on the developer carrying member 305 is pressed against the surface of the developer carrying member 305 by a developer layer thickness control member 307, so that its layer is formed in a uniform thickness. The non-magnetic toner is, as a result of the friction between toner particles one another, the friction between it and the developer carrying member 305 and the friction between it and the developer layer thickness control member 307, provided with triboelectric charges sufficient for developing the electrostatic latent image formed on the photosensitive drum 306. The non-magnetic toner layer formed on the developer carrying member 305 may be in a thickness smaller than the minimum gap between the developer carrying member 305 and the photosensitive drum 306 in the developing zone.

In order to cause the non-magnetic toner 312 carried on the developer carrying member 305, to fly to the electrostatic latent image formed on the photosensitive drum 306 to develop the latent image, a development bias voltage may be applied to the developer carrying member 305 from a development bias power source 308. As the development bias voltage 308, it may be either of a direct-current voltage and an alternating bias voltage, and its voltage may also be set at the same voltage as the above.

In the developer container of the above developing assembly, the RS roller 311 may preferably be an elastic roller made of, e.g., resin, rubber or sponge. In place of the RS roller 311, a belt or a brush member may be used depending on cases.

It is preferable for the elastic blade 307 to be also one made of the same material, and having the same curved shape, as those of the elastic blade 107 of the magnetic one-component non-contact developing assembly shown in FIG. 1, and to be so set as to be pressed against the developer carrying member 305.

The elastic blade 307 may be brought into touch with the developer carrying member 305 at the same touch pressure as that in the case of the elastic blade 107 against the developer carrying member 105 in the magnetic one-component non-contact type shown in FIG. 1. This is preferable for the like reasons.

The above example is a non-magnetic one-component non-contact type, which, however, may also preferably be used in a non-magnetic one-component contact developing assembly, in which the non-magnetic one-component developer layer on the developer carrying member is formed in a thickness not less than the gap distance between the developer carrying member and the photosensitive drum in the developing zone D.

Developer:

The developer (toner) according to the present invention has a binder resin which contains a colorant, a charge control agent, a release agent, inorganic particles and so forth. It may be either of a magnetic toner, which contains a magnetic material as an essential component, and a non-magnetic toner, which does not contain any magnetic material. The toner may preferably have mass-average particle diameter within the range of from 4 μm or more to 10 μm or less. This is because the triboelectric charge quantity of the toner or the image quality and image density can be well balanced. As long as the toner has a mass-average particle diameter of 10 μm or less, any microdot images can be kept from being formed in a low reproducibility. On the other hand, as long as the toner has a mass-average particle diameter of 4 μm or more, any density decrease due to faulty triboelectric charging can be kept from occurring.

As the binder resin of the toner, usable are vinyl resin, polyester resin, polyurethane resin, epoxy resin and phenol resin. Of these, vinyl resin and polyester resin are preferred. For the purpose of improving triboelectric charge characteristics, a charge control agent may be used in the toner by incorporating the former in toner particles (internal addition) or blending it with toner particles (external addition). Such a charge control agent facilitates control of optimum charge quantity in accordance with developing systems.

Where the toner is used in a one-component developing assembly, the toner the charge quantity of which has been controlled as above may be used as the developer, whereby the effect of improving the charge-providing ability of the developer carrying member of the present invention can be obtained with ease.

EXAMPLES

In the following working examples, "part(s)" and "%" refer to "part(s) by mass" and "%" by mass", respectively, unless particularly noted.

1. Methods for Measuring Physical Properties

Measuring methods concerning the present invention are described first.

(1) Acrylic Resin Analytical Method:

Polymer structure of the acrylic resin was determined by analyzing with a pyrolytic GC/MS analyzer "VOYAGER" (trade name; manufactured by Thermo Electron Inc.) a sample obtained by shaving off the resin layer of the developer carrying member. The analysis was made under conditions of pyrolytic temperature: 600° C.; column: HP-1 (15 m×0.25 mm×0.25 μm); inlet: temperature 300° C.; split: 20.0; injection rate: 1.2 ml/min; heating: 50° C. (4 minutes) up to 300° C. (20° C./min).

(2) Volume Resistivity of Resin Layer:

A resin layer of 7 μm to 20 μm in thickness was formed on a PET sheet of 100 μm in thickness, and its volume resistivity was measured with a resistivity meter "LORESTAR AP" (trade name; manufactured by Mitsubishi Chemical Corporation), using a four-terminal probe. It was measured in an environment of a temperature of 20° C. to 25° C. and a humidity of 50% RH to 60% RH.

(3) Arithmetic-Mean Roughness Ra of Developer Carrying Member Surface:

The arithmetic-mean roughness Ra of the developer carrying member surface was measured according to JIS B 0601 (2001), using a surface roughness meter "SURFCORDER SE-3500" (trade name; manufactured by Kosaka Laboratory, Ltd.). It was measured under conditions of a cut-off of 0.8 mm, a measurement distance of 4 mm and a feed rate of 0.5 mm/s. It was also measured at the positions of 3 spots in the axial direction (at the middle and at positions of 80 mm each toward both ends from the middle) and 3 spots in the peripheral direction (at intervals of 120 degrees), i.e., 9 spots in total. Then, the average value of measured values was taken as the arithmetic-mean roughness Ra of the developer carrying member surface.

(4) Layer Thickness of Resin Layer:

To measure the layer thickness of the resin layer, a controller "LS-5500" (trade name; manufactured by Keyence Corporation) and a sensor head "LS-5040T" (trade name; manufactured by Keyence Corporation) were used which were of a laser dimension measuring instrument which measures the outer diameter of a cylinder by using laser light. A sensor was separately fastened to an instrument fitted with a developer carrying member fastening jig and a developer carrying member feed mechanism, where the outer diameter size of the developer carrying member was measured. It was measured at 30 spots on the developer carrying member divided into 30 areas in its lengthwise direction, and then the developer carrying member was rotated by 90 degrees in the peripheral direction, and thereafter its outer diameter was further measured at 30 spots, 60 spots in total. The average value of measured values thus found was taken as the outer diameter size of the sample member. The outer diameter size of the substrate was beforehand measured and, after the resin layer was formed, the outer diameter was again measured, where a difference between them was taken as the layer thickness of the resin layer.

2. Kinds of Materials

Production examples of acrylic resin solutions and also commercial sources of conductive particles and unevenness-providing particles, used in working examples, are shown below.

2-1. Production Examples of Acrylic Resin Solutions (1) Production Example of Acrylic Resin Solution A-1:

In a four-necked separable flask fitted with a stirrer, a condenser, a thermometer, a nitrogen feed tube and a dropping funnel, the following materials were mixed, and stirred until the system became uniform.

Dimethyllaurylamine: 31.4 parts by mass.

p-Toluenesulfonic acid:25.4 parts by mass.

Isopropyl alcohol: 80 parts by mass.

With stirring, the above materials were heated to a temperature of 80° C., followed by stirring for 2 hours to obtain a quaternary ammonium salt-containing solution. The solution obtained was cooled, and thereafter 20.9 parts by mass of glycidyl methacrylate was added thereto. The mixture obtained was heated to a temperature of 80° C. and thereafter stirred for 2 hours to obtain a quaternary ammonium salt-containing monomer.

The reaction solution obtained was cooled, and thereafter 22.3 parts by mass of N-methylol acrylamide as a copolymerization component was fed into the reaction system, followed by stirring until the system became uniform. Next, while continuing the stirring, the reaction system was heated until its interior came to be 70° C. To this system, a polymerization initiator solution prepared by dissolving 1.0 part by mass of 2,2'-azobisisobutyronitrile (AIBN) as a polymerization initiator in 50 parts by mass of isopropyl alcohol was added through the dropping funnel over a period of 1 hour. After the addition made dropwise was completed, the reaction was further carried out for 5 hours in the state of reflux under introduction of nitrogen, and 0.2 part by mass of AIBN was further added thereto. Thereafter, the reaction was carried out for 1 hour to complete the reaction.

To the solution thus obtained, 0.1 part by mass of p-toluenesulfonic acid was added, and this was further diluted with isopropyl alcohol to obtain an acrylic resin solution A-1 having a solid content of 40%. This resin solution was heated and dried at a temperature of 150° C. for 30 minutes to obtain an acrylic resin. By analysis, it was identified that this acrylic resin contained a structural unit of Formula (9).

(9)

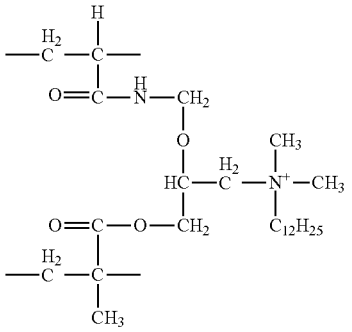

(2) Production Examples of Acrylic Resin Solutions A-2 to A-13:

Acrylic resin solutions A-2 to A-13 were obtained in the same way as the acrylic resin solution A-1 except that monomers shown in Table 1 were used and also formulated in proportions shown in Table 1. Next, these were heated and dried (at 150° C. for 30 minutes) to obtain acrylic resins, which were analyzed to identify the presence of the units shown in Table 2.

(3) Production Example of Acrylic Resin Solution A-14:

In a four-necked separable flask fitted with a stirrer, a condenser, a thermometer, a nitrogen feed tube and a dropping funnel, the following materials were mixed, and stirred until the system became uniform.

Dimethyllaurylamine: 25.4 parts by mass.

Hydrogen chloride (as effective component in aqueous 35% hydrogen chloride solution): 9.6 parts by mass.

With stirring, the above materials were heated to a temperature of 80° C., followed by stirring for 2 hours to obtain a quaternary ammonium salt-containing solution. The solution obtained was dried, and thereafter 16.9 parts by mass of glycidyl methacrylate and 80 parts by mass of isopropyl alcohol were added thereto. The mixture obtained was heated to a temperature of 80° C. and thereafter stirred for 2 hours to obtain a quaternary ammonium salt-containing monomer.

The reaction solution obtained was cooled, and thereafter 48.1 parts by mass of N-methylol acrylamide as a copolymerization component was fed into the reaction system, followed by stirring until the system became uniform. Next, while continuing the stirring, the reaction system was heated until its interior came to be 70° C. To this system, a polymerization initiator solution prepared by dissolving 1.0 part by mass of 2,2'-azobisisobutyronitrile (AIBN) as a polymerization initiator in 50 parts by mass of isopropyl alcohol was added through the dropping funnel over a period of 1 hour. After the addition made dropwise was completed, the reaction was further carried out for 5 hours in the state of reflux under introduction of nitrogen, and 0.2 part by mass of AIBN was further added thereto. Thereafter, the reaction was carried out for 1 hour to complete the reaction.

To the solution thus obtained, 0.1 part by mass of p-toluenesulfonic acid was added, and this was further diluted with isopropyl alcohol to obtain an acrylic resin solution A-14 having a solid content of 40%. Next, this was heated and dried (at 150° C. for 30 minutes) to obtain an acrylic resin, part of structure of which was as shown in Table 2.

(4) Production Examples of Acrylic Resin Solutions A-15 to A-17:

Acrylic resin solutions A-15 to A-17 were obtained in the same way as the acrylic resin solution A-14 except that monomers shown in Table 1 were used and also formulated in proportions shown in Table 1. Next, these were heated and dried (at 150° C. for 30 minutes) to obtain acrylic resins, which were analyzed to identify the presence of the units shown in Table 2.

(5) Production Examples of Acrylic Resin Solutions A-18 to A-22 and a-4:

Acrylic resin solutions A-18 to A-22 and a-4 were obtained in the same way as the acrylic resin solution A-1 except that monomers shown in Table 1 were used and also formulated in proportions shown in Table 1. Next, these were heated and dried (at 150° C. for 30 minutes) to obtain acrylic resins, which were analyzed to identify the presence of the units shown in Table 2.

(6) Production Example of Acrylic Resin Solution a-1:

In a four-necked separable flask fitted with a stirrer, a condenser, a thermometer, a nitrogen feed tube and a dropping funnel, the following materials were mixed, and stirred until the system became uniform.

Dimethyllaurylamine: 31.5 parts by mass.
p-Toluenesulfonic acid: 25.4 parts by mass.
Isopropyl alcohol: 80 parts by mass.

With stirring, the above materials were heated to a temperature of 80° C., followed by stirring for 2 hours to obtain a quaternary ammonium salt-containing solution. The solution obtained was cooled, and thereafter 21.0 parts by mass of glycidyl methacrylate was added thereto. The mixture obtained was heated to a temperature of 80° C. and thereafter stirred for 2 hours to obtain a quaternary ammonium salt-containing monomer.

The reaction solution obtained was cooled, and thereafter 22.2 parts by mass of methyl methacrylate as a copolymerization component was fed into the reaction system, followed by stirring until the system became uniform. Next, while continuing the stirring, the reaction system was heated until its interior came to be 70° C. To this system, a polymerization initiator solution prepared by dissolving 1.0 part by mass of 2,2'-azobisisobutyronitrile (AIBN) as a polymerization initiator in 50 parts by mass of isopropyl alcohol was added through the dropping funnel over a period of 1 hour. After the addition made dropwise was completed, the reaction was further carried out for 5 hours in the state of reflux under introduction of nitrogen, and 0.2 part by mass of AIBN was further added thereto. Thereafter, the reaction was carried out for 1 hour to complete the reaction.

The solution thus obtained was further diluted with isopropyl alcohol to obtain an acrylic resin solution a-1 having a solid content of 40%. This resin solution was then heated and dried (at 150° C. for 30 minutes) to obtain an acrylic resin, in which the presence of the unit (1) and unit (2) was not identified.

(7) Production Example of Acrylic Resin Solution a-2:

In a four-necked separable flask fitted with a stirrer, a condenser, a thermometer, a nitrogen feed tube and a dropping funnel, the following materials were mixed, and stirred until the system became uniform.

N-methylol acrylamide: 60.2 parts by mass.
Methyl methacrylate: 39.8 parts by mass.
Isopropyl alcohol: 100 parts by mass.

With stirring, the above materials were heated to a temperature of 70° C. To the mixture obtained, a polymerization initiator solution prepared by dissolving 1.0 part by mass of 2,2'-azobisisobutyronitrile (AIBN) as a polymerization initiator in 50 parts by mass of isopropyl alcohol was added through the dropping funnel over a period of 1 hour. After the addition made dropwise was completed, the reaction was further carried out for 5 hours in the state of reflux under introduction of nitrogen, and 0.2 part by mass of AIBN was further added thereto. Thereafter, the reaction was carried out for 1 hour to complete the reaction.

The solution thus obtained was further diluted with isopropyl alcohol to obtain an acrylic resin solution a-2 having a solid content of 40%. This resin solution was then heated and dried (at 150° C. for 30 minutes) to obtain an acrylic resin, in which the presence of the unit (1) and unit (2) was not identified.

(8) Production Example of Acrylic Resin Solution a-3:

Acrylic resin solution a-3 was obtained in the same way as the acrylic resin solution a-2 except that monomers shown in Table 1 were used and also formulated in a proportion shown in Table 1. Next, this was heated and dried (at 150° C. for 30 minutes) to obtain an acrylic resin, in which the presence of the unit (1) and unit (2) was not identified.

TABLE 1

| Acrylic resin solution | Monomer (3); a: Copolymerization component Type | pbm | a/(a + b + c) | Monomer (4); b: Acid component: Organic amine Type | pbm | Type | pbm | Monomer Type | pbm | b/(a + b + c) | Monomer (8); c: Other monomer Type | pbm | c/(a + b + c) |
|---|---|---|---|---|---|---|---|---|---|---|---|---|---|
| A-1 | MAA | 22.3 | 0.6 | Dimethyllaurylamine | 31.4 | PPTS | 25.4 | GMA | 20.9 | 0.4 | — | — | — |
| A-2 | MAA | 25.2 | 0.6 | Dimethyllaurylamine | 35.4 | MSA | 15.8 | GMA | 23.6 | 0.4 | — | — | — |
| A-3 | EAA | 24.7 | 0.6 | Dimethyllaurylamine | 30.5 | PPTS | 24.6 | GMA | 20.3 | 0.4 | — | — | — |
| A-4 | MAA | 22.8 | 0.6 | Dimethyllaurylamine | 32.1 | PPTS | 25.9 | GA | 19.3 | 0.4 | — | — | — |
| A-5 | MAA | 28.9 | 0.6 | Trimethylamine | 11.2 | PPTS | 32.8 | GMA | 27.1 | 0.4 | — | — | — |
| A-6 | MAA | 26.7 | 0.6 | Dimethylbutylamine | 17.8 | PPTS | 30.4 | GMA | 25.1 | 0.4 | — | — | — |
| A-7 | MAA | 24.3 | 0.6 | Dimethyloctylamine | 25.2 | PPTS | 27.6 | GMA | 22.8 | 0.4 | — | — | — |

TABLE 1-continued

| Acrylic resin solution | Monomer (3); a Copolymerization component Type | pbm | a/ (a + b + c) | Monomer (4); b Organic amine Type | pbm | Acid component Type | pbm | Monomer Type | pbm | b/ (a + b + c) | Monomer (8); c Other monomer Type | pbm | c/ (a + b + c) |
|---|---|---|---|---|---|---|---|---|---|---|---|---|---|
| A-8 | MAA | 18.5 | 0.6 | Trioctylamine | 43.1 | PPTS | 21.0 | GMA | 17.3 | 0.4 | — | — | — |
| A-9 | MAA | 19.9 | 0.6 | Dimethylstearylamine | 39.0 | PPTS | 22.6 | GMA | 18.6 | 0.4 | — | — | — |
| A-10 | MAA | 11.3 | 0.4 | Dimethyllaurylamine | 35.8 | PPTS | 28.9 | GMA | 23.9 | 0.6 | — | — | — |
| A-11 | MAA | 43.4 | 0.8 | Dimethyllaurylamine | 22.9 | PPTS | 18.5 | GMA | 15.3 | 0.2 | — | — | — |
| A-12 | EAA | 30.5 | 0.6 | Dimethyloctylamine | 27.7 | MSA | 16.8 | GMA | 25.1 | 0.4 | — | — | — |
| A-13 | MAA | 14.0 | 0.4 | Dimethylbutylamine | 20.9 | PPTS | 35.7 | GMA | 29.4 | 0.6 | — | — | — |
| A-14 | MAA | 48.1 | 0.8 | Dimethyllaurylamine | 25.4 | HCl | 9.6 | GMA | 16.9 | 0.2 | — | — | — |
| A-15 | MAA | 43.2 | 0.8 | Trioctylamine | 37.7 | HBr | 3.9 | GMA | 15.2 | 0.2 | — | — | — |
| A-16 | MAA | 13.4 | 0.4 | Dimethyllaurylamine | 42.3 | HBr | 16.1 | GMA | 28.2 | 0.6 | — | — | — |
| A-17 | MAA | 24.7 | 0.6 | Dimethylstearylamine | 48.5 | HCl | 6.0 | GA | 20.9 | 0.4 | — | — | — |
| A-18 | MAA | 21.3 | 0.5 | Dimethyllaurylamine | 27.0 | PPTS | 21.8 | GMA | 18.0 | 0.3 | n-BMA | 12.0 | 0.2 |
| A-19 | MAA | 20.3 | 0.5 | Dimethyllaurylamine | 25.7 | PPTS | 20.8 | GMA | 17.2 | 0.3 | OMA | 16.0 | 0.2 |
| A-20 | MAA | 19.5 | 0.5 | Dimethyllaurylamine | 24.6 | PPTS | 19.9 | GMA | 16.4 | 0.3 | RMA | 19.6 | 0.2 |
| A-21 | MAA | 35.1 | 0.6 | Dimethyllaurylamine | 12.3 | PPTS | 10.0 | GMA | 8.2 | 0.1 | OMA | 34.4 | 0.3 |
| A-22 | MAA | 10.1 | 0.3 | Dimethyllaurylamine | 28.4 | PPTS | 22.9 | GMA | 18.9 | 0.4 | OMA | 19.8 | 0.3 |
| a-1 | — | — | — | Dimethyllaurylamine | 31.5 | PPTS | 25.4 | GMA | 21.0 | 0.4 | MMA | 22.2 | 0.6 |
| a-2 | MAA | 60.2 | 0.6 | — | — | — | — | — | — | — | MMA | 39.8 | 0.4 |
| a-3 | — | — | — | — | — | — | — | — | — | — | MMA | 100.0 | 1 |
| a-4 | MAA | 18.5 | 0.6 | Dimethylbehenylamine | 43.1 | PPTS | 21.0 | GMA | 17.3 | 0.4 | — | — | — |

pbm: parts by mass
MAA: N-methylol acrylamide
EAA: N-ethylol acrylamide
GMA: Glycidyl methacrylate
GA: Glycidyl acrylate
PPTS: p-Toluenesulfonic acid
MSA: Methylsulfonic acid
n-BMA: n-Butyl methacrylate
OMA: Octyl methacrylate
RMA: Lauryl methacrylate
MMA: Methyl methacrylate

TABLE 2

| Acrylic resin solution | Unit (1) $R_1$ | $R_2$ | Unit (2) $R_3$ | $R_4$ | $R_5$ | $R_6$ | $R_7$ | $A^-$ |
|---|---|---|---|---|---|---|---|---|
| A-1 | H | $CH_2$ | $CH_3$ | $C_2H_4$ | $CH_3$ | $CH_3$ | $C_{12}H_{25}$ | PPTS |
| A-2 | H | $CH_2$ | $CH_3$ | $C_2H_4$ | $CH_3$ | $CH_3$ | $C_{12}H_{25}$ | MSA |
| A-3 | H | $C_2H_4$ | $CH_3$ | $C_2H_4$ | $CH_3$ | $CH_3$ | $C_{12}H_{25}$ | PPTS |
| A-4 | H | $CH_2$ | H | $C_2H_4$ | $CH_3$ | $CH_3$ | $C_{12}H_{25}$ | PPTS |
| A-5 | H | $CH_2$ | $CH_3$ | $C_2H_4$ | $CH_3$ | $CH_3$ | $CH_3$ | PPTS |
| A-6 | H | $CH_2$ | $CH_3$ | $C_2H_4$ | $CH_3$ | $CH_3$ | $C_4H_9$ | PPTS |
| A-7 | H | $CH_2$ | $CH_3$ | $C_2H_4$ | $CH_3$ | $CH_3$ | $C_8H_{17}$ | PPTS |
| A-8 | H | $CH_2$ | $CH_3$ | $C_2H_4$ | $C_8H_{17}$ | $C_8H_{17}$ | $C_8H_{17}$ | PPTS |
| A-9 | H | $CH_2$ | $CH_3$ | $C_2H_4$ | $CH_3$ | $CH_3$ | $C_{18}H_{37}$ | PPTS |
| A-10 | H | $CH_2$ | $CH_3$ | $C_2H_4$ | $CH_3$ | $CH_3$ | $C_{12}H_{25}$ | PPTS |
| A-11 | H | $CH_2$ | $CH_3$ | $C_2H_4$ | $CH_3$ | $CH_3$ | $C_{12}H_{25}$ | PPTS |
| A-12 | H | $C_2H_4$ | $CH_3$ | $C_2H_4$ | $CH_3$ | $CH_3$ | $C_8H_{17}$ | MSA |
| A-13 | H | $CH_2$ | $CH_3$ | $C_2H_4$ | $CH_3$ | $CH_3$ | $C_4H_9$ | PPTS |
| A-14 | H | $CH_2$ | $CH_3$ | $C_2H_4$ | $CH_3$ | $CH_3$ | $C_{12}H_{25}$ | Cl |
| A-15 | H | $CH_2$ | $CH_3$ | $C_2H_4$ | $C_8H_{17}$ | $C_8H_{17}$ | $C_8H_{17}$ | Br |
| A-16 | H | $CH_2$ | $CH_3$ | $C_2H_4$ | $CH_3$ | $CH_3$ | $C_{12}H_{25}$ | Br |
| A-17 | H | $CH_2$ | H | $C_2H_4$ | $CH_3$ | $CH_3$ | $C_{18}H_{37}$ | Cl |
| A-18 | H | $CH_2$ | $CH_3$ | $C_2H_4$ | $CH_3$ | $CH_3$ | $C_{12}H_{25}$ | PPTS |
| A-19 | H | $CH_2$ | $CH_3$ | $C_2H_4$ | $CH_3$ | $CH_3$ | $C_{12}H_{25}$ | PPTS |
| A-20 | H | $CH_2$ | $CH_3$ | $C_2H_4$ | $CH_3$ | $CH_3$ | $C_{12}H_{25}$ | PPTS |
| A-21 | H | $CH_2$ | $CH_3$ | $C_2H_4$ | $CH_3$ | $CH_3$ | $C_{12}H_{25}$ | PPTS |
| A-22 | H | $CH_2$ | $CH_3$ | $C_2H_4$ | $CH_3$ | $CH_3$ | $C_{12}H_{25}$ | PPTS |
| a-1 | — | — | — | — | — | — | — | — |
| a-2 | — | — | — | — | — | — | — | — |
| a-3 | — | — | — | — | — | — | — | — |
| a-4 | H | $CH_2$ | $CH_3$ | $C_2H_4$ | $CH_3$ | $CH_3$ | $C_{22}H_{45}$ | PPTS |

PPTS: p-Toluenesulfonic acid
MSA: Methylsulfonic acid 2-2. Conductive Particles

As the conductive particles used in the developer carrying member, the following particles were used.

Conductive particles B-1: "TOKA BLACK #5500" (trade name; available from Tokai Carbon Co., Ltd.

Conductive particles B-2: Graphite particles "CSP-E" (trade name; available from Nippon Graphite Industries, Ltd.; primary average particle diameter: 4.6 μm).

2-3. Unevenness-Providing Particles

As the unevenness-providing particles used in the developer carrying member, the following particles were used.

Unevenness-providing particles C-1: "NICABEADS ICB-0520" (trade name; available from Nippon Carbon Co., Ltd.)

Example 1

(1) Production of Developer Carrying Member D-1:

A developer carrying member D-1 was produced in the following way. First, the following materials were mixed, and the mixture obtained was dispersion-treated by means of a sand mill "Horizontal-type Ready Mill NVM-03 (trade name; manufactured by AIMEX Co., Ltd.) (glass beads of 1.0 mm in diameter, in a packing of 85%) to obtain a coating fluid.

Acrylic resin solution A-1: 250 parts by mass (solid content: 100 parts by mass.)

Conductive particles B-1: 7 parts by mass.

Conductive particles B-2: 60 parts by mass.

Unevenness-providing particles C-1:10 parts by mass.

Isopropyl alcohol: 200 parts by mass.

One having the same shape as a cylindrical pipe made of aluminum, of a developer carrying member fitted to a purepart cartridge "LASER JET Q5942A Print Cartridge Black" (trade name; manufactured by Hewlett-Packard Co.) of "LASER JET 4350n" (trade name; manufactured by Hewlett-Packard Co.) was readied as a substrate.

This substrate was masked at its both end portions by 6 mm each, and thereafter the substrate was so placed that its axis was parallel to the vertical. Then, this substrate was rotated at 1,500 rpm, and was coated with the coating fluid while a spray gun was descended at 35 mm/second, to form a coating in such a way that it came to be 7 μm in thickness as a result of hardening. Subsequently, the coating was hardened by heating it for 30 minutes in a temperature 150° C. hot-air drying oven, to obtain a developer carrying member, D-1.

(2) Setup of Electrophotographic Image Forming Apparatus, and Image Evaluation Making Use of the Same:

A magnet roller was set in the developer carrying member D-1 obtained, and this was fitted to a cartridge "LASER JET Q5942A Print Cartridge Black" (trade name; manufactured by Hewlett-Packard Co.) to make up a developing assembly. This was mounted to a printer "LASER JET 4350n" (trade name; manufactured by Hewlett-Packard Co.) to make the following image evaluation. Incidentally, the printer "LASER JET 4350n" is an electrophotographic image forming apparatus having the magnetic one-component non-contact developing assembly shown in FIG. 1. That is, this developing assembly has a magnetic one-component developer and also has an elastic blade as the developer layer thickness control member. Also, the developer carrying member is provided in its interior with a magnet.

The image evaluation was made in three environments, a high-temperature and high-humidity environment (H/H), a normal-temperature and normal-humidity environment (N/N) and a low-temperature and low-humidity environment (L/L). The evaluation in the high-temperature and high-humidity environment was made in an environment of temperature 32.5° C. and humidity 80% RH after the developing assembly was left to stand for 2 weeks in an environment of temperature 40° C. and humidity 85% RH. The evaluation in the normal-temperature and normal-humidity environment was made in an environment of temperature 23° C. and humidity 50% RH after the developing assembly was left to stand for 2 weeks in the like environment. The evaluation in the low-temperature and low-humidity environment was made in an environment of temperature 15° C. and humidity 10% RH after silica gel and the developing assembly were put into a desiccator and this was left to stand for 2 weeks at a temperature of 15° C.

In the above respective environments, letter size sheets "BUSINESS 4200" (trade name; available from Xerox Corporation; 75 g/m$^2$) were used, and character images with a print percentage of 3% were continuously printed on up to 100 sheets in A4-size longitudinal feed, and thereafter images were evaluated.

Evaluation item was image density. Using a reflection densitometer "RD918" (trade name; manufactured by Macbeth Co.), the density of solid black areas when solid black images were printed was measured at 5 spots, and an arithmetic-mean value thereof was taken as the image density. Also, a percentage change in image density between that in the low-temperature and low-humidity environment and that in the high-temperature and high-humidity environment was calculated. The results of evaluation are shown in Table 4.

Examples 2 to 22 & Comparative Examples 1 to 4

Developer carrying members D-2 to D-22 and d-1 to d-4 were produced in the same way as Example 1 except that those respectively shown in Table 3 were used as coating fluids. These were fitted to the cartridges, which were then each mounted to the printer to make evaluation. The results are shown in Table 4.

TABLE 3

| | Developer carrying member | Acrylic resin | | Conductive particles | | | | Unevenness-providing particles | |
|---|---|---|---|---|---|---|---|---|---|
| | | | pbm (solid | 1 | | 2 | | | |
| | | Type | content) | Type | pbm | Type | pbm | Type | pbm |
| Example: | | | | | | | | | |
| 1 | D-1 | A-1 | 100 | B-1 | 7 | B-2 | 60 | C-1 | 10 |
| 2 | D-2 | A-2 | 100 | B-1 | 7 | B-2 | 60 | C-1 | 10 |
| 3 | D-3 | A-3 | 100 | B-1 | 7 | B-2 | 60 | C-1 | 10 |
| 4 | D-4 | A-4 | 100 | B-1 | 7 | B-2 | 60 | C-1 | 10 |
| 5 | D-5 | A-5 | 100 | B-1 | 7 | B-2 | 60 | C-1 | 10 |
| 6 | D-6 | A-6 | 100 | B-1 | 7 | B-2 | 60 | C-1 | 10 |
| 7 | D-7 | A-7 | 100 | B-1 | 7 | B-2 | 60 | C-1 | 10 |
| 8 | D-8 | A-8 | 100 | B-1 | 7 | B-2 | 60 | C-1 | 10 |
| 9 | D-9 | A-9 | 100 | B-1 | 7 | B-2 | 60 | C-1 | 10 |
| 10 | D-10 | A-10 | 100 | B-1 | 7 | B-2 | 60 | C-1 | 10 |
| 11 | D-11 | A-11 | 100 | B-1 | 7 | B-2 | 60 | C-1 | 10 |
| 12 | D-12 | A-12 | 100 | B-1 | 7 | B-2 | 60 | C-1 | 10 |
| 13 | D-13 | A-13 | 100 | B-1 | 7 | B-2 | 60 | C-1 | 10 |
| 14 | D-14 | A-14 | 100 | B-1 | 7 | B-2 | 60 | C-1 | 10 |
| 15 | D-15 | A-15 | 100 | B-1 | 7 | B-2 | 60 | C-1 | 10 |
| 16 | D-16 | A-16 | 100 | B-1 | 7 | B-2 | 60 | C-1 | 10 |
| 17 | D-17 | A-17 | 100 | B-1 | 7 | B-2 | 60 | C-1 | 10 |
| 18 | D-18 | A-18 | 100 | B-1 | 7 | B-2 | 60 | C-1 | 10 |
| 19 | D-19 | A-19 | 100 | B-1 | 7 | B-2 | 60 | C-1 | 10 |
| 20 | D-20 | A-20 | 100 | B-1 | 7 | B-2 | 60 | C-1 | 10 |
| 21 | D-21 | A-21 | 100 | B-1 | 7 | B-2 | 60 | C-1 | 10 |
| 22 | D-22 | A-22 | 100 | B-1 | 7 | B-2 | 60 | C-1 | 10 |

TABLE 3-continued

| | Developer carrying member | Acrylic resin Type | pbm (solid content) | Conductive particles 1 Type | pbm | 2 Type | pbm | Unevenness-providing particles Type | pbm |
|---|---|---|---|---|---|---|---|---|---|
| Comparative Example: | | | | | | | | | |
| 1 | d-1 | a-1 | 100 | B-1 | 7 | B-2 | 60 | C-1 | 10 |
| 2 | d-2 | a-2 | 100 | B-1 | 7 | B-2 | 60 | C-1 | 10 |
| 3 | d-3 | a-3 | 100 | B-1 | 7 | B-2 | 60 | C-1 | 10 |
| 4 | d-4 | a-4 | 100 | B-1 | 7 | B-2 | 60 | C-1 | 10 |

pbm: parts by mass

TABLE 4

| | Developer carrying member | Image density HH | NN | LL | Percentage change in density 1-(HH/LL) |
|---|---|---|---|---|---|
| Example: | | | | | |
| 1 | D-1 | 1.42 | 1.43 | 1.44 | 1.4% |
| 2 | D-2 | 1.41 | 1.43 | 1.44 | 2.1% |
| 3 | D-3 | 1.41 | 1.43 | 1.45 | 2.8% |
| 4 | D-4 | 1.42 | 1.43 | 1.45 | 2.1% |
| 5 | D-5 | 1.34 | 1.36 | 1.36 | 1.5% |
| 6 | D-6 | 1.36 | 1.37 | 1.39 | 2.2% |
| 7 | D-7 | 1.40 | 1.41 | 1.42 | 1.4% |
| 8 | D-8 | 1.39 | 1.41 | 1.42 | 2.1% |
| 9 | D-9 | 1.42 | 1.44 | 1.46 | 2.7% |
| 10 | D-10 | 1.41 | 1.45 | 1.46 | 3.4% |
| 11 | D-11 | 1.38 | 1.40 | 1.40 | 1.4% |
| 12 | D-12 | 1.40 | 1.43 | 1.44 | 2.8% |
| 13 | D-13 | 1.38 | 1.42 | 1.43 | 3.5% |
| 14 | D-14 | 1.37 | 1.38 | 1.39 | 1.4% |
| 15 | D-15 | 1.38 | 1.40 | 1.41 | 2.1% |
| 16 | D-16 | 1.40 | 1.42 | 1.44 | 2.8% |
| 17 | D-17 | 1.40 | 1.43 | 1.44 | 2.8% |
| 18 | D-18 | 1.40 | 1.41 | 1.44 | 2.8% |
| 19 | D-19 | 1.40 | 1.42 | 1.43 | 2.1% |
| 20 | D-20 | 1.42 | 1.43 | 1.45 | 2.1% |
| 21 | D-21 | 1.35 | 1.36 | 1.37 | 1.5% |
| 22 | D-22 | 1.38 | 1.42 | 1.45 | 4.8% |
| Comparative Example: | | | | | |
| 1 | d-1 | 1.26 | 1.42 | 1.47 | 14.3% |
| 2 | d-2 | 1.18 | 1.26 | 1.32 | 10.6% |
| 3 | d-3 | 1.13 | 1.23 | 1.28 | 11.7% |
| 4 | d-4 | 1.30 | 1.47 | 1.50 | 13.3% |

As Table 4 shows, the results of evaluation of Examples 1 to 22 were good. On the other hand, the developer carrying member d-1 of Comparative Example 1 did not contain the unit (1) and unit (2) in the acrylic resin, and tended to be affected by moisture. Hence, it showed a large percentage change in image density between that in the high-temperature and high-humidity environment and that in the low-temperature and low-humidity environment.

The developer carrying members d-2 and d-3 of Comparative Examples 2 and 3 also did not contain the unit (1) and unit (2) in the acrylic resin, and tended to be affected by moisture. Hence, they showed a large percentage change in image density between that in the high-temperature and high-humidity environment and that in the low-temperature and low-humidity environment. Also, because of their low charge-providing ability, a low image density came. The developer carrying member d-4 of Comparative Example 4 had an acrylic resin in the structure of which the $R_7$ alkyl group had carbon atoms of 22, which was so large as to result in an insufficient dispersibility for the coating fluid, and hence it showed a large percentage change in image density between that in the high-temperature and high-humidity environment and that in the low-temperature and low-humidity environment.

Example 23

(1) Production of Developer Carrying Member E-23:

A coating fluid was obtained in the same way as Example 1 except that the coating fluid was formulated in a proportion as shown below.

Acrylic resin solution A-1: 250 parts by mass (solid content: 100 parts by mass.)

Conductive particles B-1: 4 parts by mass.

Conductive particles B-2: 36 parts by mass.

Unevenness-providing particles C-1:8 parts by mass.

Isopropyl alcohol: 150 parts by mass.

One having the same shape as a cylindrical pipe made of aluminum, of a developer carrying member fitted to a developing assembly of "iR2545" (trade name; manufactured by CANON INC.) was readied as a substrate.

This substrate was masked at its both end portions by 8 mm each, and thereafter the substrate was so placed that its axis was parallel to the vertical. Then, this substrate was rotated at 1,000 rpm, and was coated with the coating fluid while a spray gun was descended at 25 mm/second, to form a coating in such a way that it came to be 13 μm in thickness as a result of hardening. Subsequently, the coating was hardened by heating it for 30 minutes in a temperature 150° C. hot-air drying oven, to obtain a developer carrying member, E-23.

(2) Setup of Electrophotographic Image Forming Apparatus, and Image Evaluation Making Use of the Same:

A magnet roller was inserted to the developer carrying member E-23 obtained, and flanges were attached to its both ends. This developer carrying member was fitted, as a developing roller, to a developing assembly of an electrophotographic image forming apparatus "iR2545" (trade name; manufactured by CANON INC.). The gap between its magnetic doctor blade and the developer carrying member E-23 was set to 230 μm. This developing assembly was mounted to the above electrophotographic image forming apparatus to make image evaluation in the same three environments as Example 1.

Incidentally, the electrophotographic image forming apparatus "iR2545" is one having the non-contact developing assembly making use of a magnetic one-component developer as shown in FIG. 2. That is, this developing assembly has a magnetic one-component developer and also has an elastic blade as the developer layer thickness control member. Also, the developer carrying member is provided in its interior with a magnet.

Here, in the image evaluation, A4-size plain paper "CS-680" (trade name; available from CANON INC.; 68 g/m$^2$) was used, and character images with a print percentage of 3% were continuously copied on up to 1,000 sheets in A4-size longitudinal feed, and thereafter images were evaluated. The results are shown in Table 6.

Comparative Examples 5 and 6

Developer carrying members e-5 and e-6 were produced in the same way as Example 23 except that those respectively shown in Table 5 were used as coating fluids. These were fitted to the developing assemblies, which were then each mounted to the electrophotographic image forming apparatus to make the image evaluation. The results are shown in Table 6.

TABLE 5

| | Developer carrying member | Acrylic resin Type | Acrylic resin pbm (solid content) | Conductive particles 1 Type | Conductive particles 1 pbm | Conductive particles 2 Type | Conductive particles 2 pbm | Unevenness-providing particles Type | Unevenness-providing particles pbm |
|---|---|---|---|---|---|---|---|---|---|
| Example: | | | | | | | | | |
| 23 | E-23 | A-1 | 100 | B-1 | 4 | B-2 | 36 | C-1 | 8 |
| Comparative Example: | | | | | | | | | |
| 5 | e-5 | a-1 | 100 | B-1 | 4 | B-2 | 36 | C-1 | 8 |
| 6 | e-6 | a-2 | 100 | B-1 | 4 | B-2 | 36 | C-1 | 8 |

pbm: parts by mass

TABLE 6

| | Developer carrying member | Image density HH | Image density NN | Image density LL | Percentage change in density 1-(HH/LL) |
|---|---|---|---|---|---|
| Example: | | | | | |
| 23 | E-23 | 1.42 | 1.44 | 1.45 | 2.1% |
| Comparative Example: | | | | | |
| 5 | e-5 | 1.24 | 1.41 | 1.46 | 15.1% |
| 6 | e-6 | 1.15 | 1.25 | 1.3 | 11.5% |

As Table 6 shows, the results of evaluation of Example 23 were good. On the other hand, the developer carrying member e-5 of Comparative Example 5 did not contain the unit (1) and unit (2) in the acrylic resin, and tended to be affected by moisture. Hence, it showed a large percentage change in image density between that in the high-temperature and high-humidity environment and that in the low-temperature and low-humidity environment.

The developer carrying member e-6 of Comparative Example 6 also did not contain the unit (1) and unit (2) in the acrylic resin, and tended to be affected by moisture. Hence, it showed a large percentage change in image density between that in the high-temperature and high-humidity environment and that in the low-temperature and low-humidity environment. Also, because of its low charge-providing ability, a low image density came.

Example 24

(1) Production of Developer Carrying Member F-24:

A coating fluid was obtained in the same way as Example 1 except that the coating fluid was formulated in a proportion as shown below.

Acrylic resin solution A-1: 250 parts by mass (solid content: 100 parts by mass.)

Conductive particles B-1: 4 parts by mass.

Conductive particles B-2: 30 parts by mass.

Unevenness-providing particles C-1:10 parts by mass.

Isopropyl alcohol: 100 parts by mass.

One having the same shape as a cylindrical pipe made of aluminum, of a developer carrying member fitted to a magenta cartridge "EP82" (trade name; manufactured by CANON INC.) of "LBP2160" (trade name; manufactured by CANON INC.) was readied as a substrate.

This substrate was masked at its both end portions by 6 mm each, and thereafter the substrate was so placed that its axis was parallel to the vertical. Then, this substrate was rotated at 1,500 rpm, and was coated with the coating fluid while a spray gun was descended at 35 mm/second, to form a coating, which was formed and then dried in such a way that it came to be 10 μm in thickness as a result of hardening and in the same way as Example 1 for the other conditions, to obtain a developer carrying member, F-24.

(2) Setup of Electrophotographic Image Forming Apparatus, and Image Evaluation Making Use of the Same:

The developer carrying member F-24 obtained was fitted to the cartridge "EP82" (trade name; manufactured by CANON INC.) to make up a developing assembly. This was mounted to a printer "LBP2160" (trade name; manufactured by CANON INC.) to make image evaluation in the same three environments as Example 1. The results are shown in Table 8.

Incidentally, the printer "LBP2160" is one having the non-magnetic one-component non-contact developing assembly making use of a non-magnetic toner as shown in FIG. 3. That is, it has a non-magnetic one-component developer (non-magnetic toner) and also has an elastic blade as the developer layer thickness control member.

Comparative Examples 7 and 8

Developer carrying members f-7 and f-8 were produced in the same way as Example 24 except that those respectively shown in Table 7 were used as coating fluids. These were fitted to the cartridges, which were then each mounted to the printer to make the image evaluation. The results are shown in Table 8.

TABLE 7

| | Developer carrying member | Acrylic resin Type | Acrylic resin pbm (solid content) | Conductive particles 1 Type | Conductive particles 1 pbm | Conductive particles 2 Type | Conductive particles 2 pbm | Unevenness-providing particles Type | Unevenness-providing particles pbm |
|---|---|---|---|---|---|---|---|---|---|
| Example: | | | | | | | | | |
| 24 | F-24 | A-1 | 100 | B-1 | 4 | B-2 | 30 | C-1 | 10 |
| Comparative Example: | | | | | | | | | |
| 7 | f-7 | a-1 | 100 | B-1 | 4 | B-2 | 30 | C-1 | 10 |
| 8 | f-8 | a-2 | 100 | B-1 | 4 | B-2 | 360 | C-1 | 10 |

pbm: parts by mass

TABLE 8

| | Developer carrying member | Image density HH | Image density NN | Image density LL | Percentage change in density 1-(HH/LL) |
|---|---|---|---|---|---|
| Example: | | | | | |
| 24 | F-24 | 1.41 | 1.43 | 1.45 | 2.8% |
| Comparative Example: | | | | | |
| 7 | f-7 | 1.25 | 1.42 | 1.46 | 14.4% |
| 8 | f-8 | 1.17 | 1.25 | 1.31 | 10.7% |

As Table 8 shows, the results of evaluation of Example 24 were good. On the other hand, the developer carrying member f-7 of Comparative Example 7 did not contain the unit (1) and unit (2) in the acrylic resin, and tended to be affected by moisture. Hence, it showed a large percentage change in image density between that in the high-temperature and high-humidity environment and that in the low-temperature and low-humidity environment.

The developer carrying member f-8 of Comparative Example 8 also did not contain the unit (1) and unit (2) in the acrylic resin, and tended to be affected by moisture. Hence, it showed a large percentage change in image density between that in the high-temperature and high-humidity environment and that in the low-temperature and low-humidity environment. Also, because of its low charge-providing ability, a low image density came.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-170042, filed Aug. 3, 2011, which is hereby incorporated by reference herein in its entirety.

What is claimed is:

1. A developer carrying member comprising a substrate, and a resin layer containing an acrylic resin, wherein: said acrylic resin has a unit (1) represented by the following formula (1), and a unit (2) represented by the following formula (2):

(1)

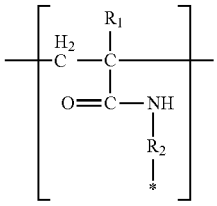

where, in the formula (1), $R_1$ represents a hydrogen atom or a methyl group, $R_2$ represents an alkylene group having 1 to 4 carbon atoms, and an asterisk * represents the part of linkage to the part shown by a double asterisk ** in the formula (2); and (2)

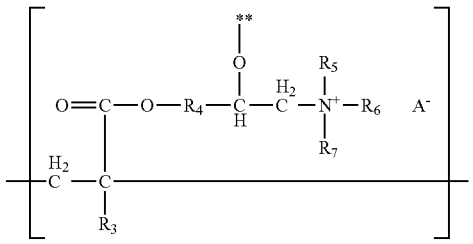

where, in the formula (2), $R_3$ represents a hydrogen atom or a methyl group; $R_4$ represents an alkylene group having 1 to 4 carbon atom(s); $R_5$, $R_6$ and $R_7$ each represent an alkyl group having 1 to 18 carbon atoms; $A^-$ represents an anion;

and a double asterisk ** represents the part of linkage to the part shown by an asterisk * in the formula (1).

2. The developer carrying member according to claim 1, wherein said acrylic resin further has a unit (5) represented by the following formula (5):

(5)

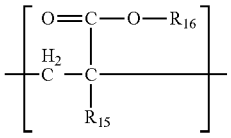

where, in the formula (5), $R_{15}$ represents a hydrogen atom or a methyl group, and $R_{16}$ represents an alkyl group having 1 to 18 carbon atoms.

3. The developer carrying member according to claim 1, wherein said resin layer has a layer thickness of from 4 μm to 30 μm or less.

4. The developer carrying member according to claim 1, wherein said resin layer further contains conductive particles.

5. The developer carrying member according to claim 4, wherein said resin layer has a volume resistivity of $10^{-3}$ Ω·cm or more to $10^{3}$ Ω·cm or less.

6. A developing assembly comprising:

a negatively triboelectrically chargeable developer comprising toner particles;

a container containing the developer therein;

a developer carrying member for carrying and transporting thereon said developer contained in the container; and a developer layer thickness control member; said developing assembly transporting, while forming a developer layer on the developer carrying member by means of the developer layer thickness control member, said developer on said developer carrying member to a developing zone facing an electrostatic latent image bearing member, developing an electrostatic latent image which said electrostatic latent image bearing member has, and forming a toner image on said electrostatic latent image bearing member; wherein said developer carrying member is the developer carrying member according to claim 1.

7. The developing assembly according to claim 6, wherein;

said developer is a magnetic one-component developer comprising magnetic toner particles;

said developer carrying member has a magnet inside thereof; and said developer layer thickness control member is an elastic blade.

8. The developing assembly according to claim 6, wherein;

said developer is a magnetic one-component developer comprising magnetic toner particles;

said developer carrying member has a magnet inside thereof; and said developer layer thickness control member is a magnetic blade.

9. The developing assembly according to claim 6, wherein;

said developer is a non-magnetic one-component developer; and said developer layer thickness control member is an elastic blade.

10. A method for producing a developer carrying member comprising a substrate and a resin layer, said resin layer containing an acrylic resin, comprising a step of:

obtaining said acrylic resin through a reaction comprising the following polymerization reactions A and B:

Polymerization reaction A: Radical polymerization reaction between monomers selected from a monomer (3) represented by the following formula (3) and a monomer (4) represented by the following formula (4);

Polymerization reaction B: Dehydration polycondensation reaction of the hydroxyl group of the monomer (3) and the hydroxyl group of the monomer (4):

(3)

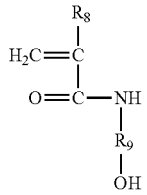

where, in the formula (3), $R_8$ represents a hydrogen atom or a methyl group, and $R_9$ represents an alkylene group having 1 to 4 carbon atoms; and (4)

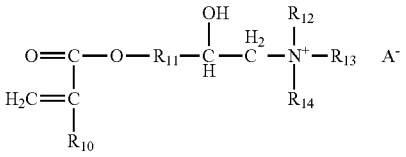

where, in the formula (4), $R_{10}$ represents a hydrogen atom or a methyl group; $R_{11}$ represents an alkylene group having 1 to 4 carbon atom(s); $R_{12}$, $R_{13}$ and $R_{14}$ each independently represent an alkyl group having 1 to 18 carbon atoms; and $A^-$ represents an anion.

* * * * *